US005868877A

United States Patent [19]

Brenneman

[11] Patent Number: 5,868,877

[45] Date of Patent: Feb. 9, 1999

[54] COPPER ALLOY HAVING IMPROVED STRESS RELAXATION

[75] Inventor: William L. Brenneman, Cheshire, Conn.

[73] Assignee: Olin Corporation, New Haven, Conn.

[21] Appl. No.: 898,053

[22] Filed: Jul. 22, 1997

[51] Int. Cl.[6] ..... C22C 9/00

[52] U.S. Cl. ..... 148/432; 420/496; 420/499

[58] Field of Search ..... 148/432; 420/496, 420/499

[56] References Cited

U.S. PATENT DOCUMENTS

| | | | |
|---|---|---|---|
| 3,677,745 | 7/1972 | Finlay et al. . | |
| 3,778,745 | 12/1973 | Finlay et al. . | |
| 4,202,688 | 5/1980 | Crane et al. . | |
| 4,305,762 | 12/1981 | Caron et al. . | |
| 4,605,532 | 8/1986 | Knorr et al. . | |
| 5,334,346 | 8/1994 | Kim et al. | 420/499 |

FOREIGN PATENT DOCUMENTS 58-199835 11/1983 Japan .

OTHER PUBLICATIONS

*ASM Handbook*®, vol. 2, "Properties and Selection: Nonferrous Alloys and Special–Purpose Materials" (Jan. 1992) pp. 260–263 (Stress–Relaxation Characteristics) and 295 (C19700).

*Primary Examiner*—John Sheehan

*Attorney, Agent, or Firm*—Gregory S. Rosenblatt; Wiggin & Dana

[57] ABSTRACT

A copper alloy having improved resistance to stress relaxation contains controlled additions of iron, phosphorous and magnesium. Free magnesium, in solid solution with the copper, increases the alloy's resistance to stress relaxation. Copper alloys of the invention retain at least 70% of the initial stress following exposure to a temperature of 105° C. for 3000 hours, making the alloys particularly useful for electrical connector components.

18 Claims, 4 Drawing Sheets

COPPER ALLOY HAVING IMPROVED STRESS RELAXATION

CROSS-REFERENCE TO RELATED APPLICATION

This patent application is related to commonly owned U.S. patent application Ser. No. 09/898,694 entitled "Copper Alloy with Magnesium Addition" by William L. Brenneman et al. filed on even date. That patent application is incorporated by reference herein.

BACKGROUND OF THE INVENTION

1. Field of the Invention

This invention relates to a copper alloy having high strength, high electrical conductivity and a resistance to stress relaxation at elevated temperatures. More particularly, the resistance to stress relaxation is enhanced by the presence of magnesium in solution with the copper.

2. Description of Related Art

Elemental copper has a very high electrical conductivity and relatively low strength and poor resistance to stress relaxation. Stress relaxation is an important consideration when selecting a copper alloy for an application where the product will be subjected to external stresses, such as when used for a spring or an electrical connector component.

Stress relaxation is a phenomenon that occurs when an external stress is applied to a piece of metal. The metal reacts by developing an equal and opposite internal stress. If the metal is restrained in the strained position, the internal stress decreases as a function of time. The gradual decrease in internal stress is called stress relaxation and happens because of the transformation of elastic strain in the metal to plastic, or permanent, strain. The rate of decrease of internal stress with time is a function of alloy composition, alloy temper, orientation and exposure temperature. It is desirable to reduce the rate of decrease, i.e. to increase the resistance to stress relaxation, as much as possible for spring and connector applications.

In the manufacture of an electrical connector, a sheet of copper alloy may be deformed into a hollow, generally cylindrical shape for use as a socket. Metal adjacent to an open end of the cylinder is externally stressed, such as by bending, to develop an opposing internal stress effective to cause the ends of the copper strip to bias inward and tightly contact a mating plug. This tight contact insures that the electrical resistance across the connector components remains relatively constant and that, in extreme conditions, the plug resists separation from the socket.

Over time, and more rapidly at higher temperatures, stress relaxation weakens the contact force between the socket and the plug and may eventually lead to connector failure. It is a primary objective of electrical connector design to maximize the contact force between the socket and the plug to maintain good electrical conductivity through the connector.

One copper alloy used to manufacture electrical connector components is designated by the Copper Development Association (CDA, Greenwich, Conn.) as copper alloy C19700. Copper alloy C19700 has the nominal composition, by weight, of 0.3%–1.2% iron, 0.1%–0.4% phosphorous, 0.01%–0.2% magnesium and the balance copper and unavoidable impurities.

Copper alloy C19700 has a resistance to stress relaxation that is marginal for many applications at exposure temperatures of 105° C. or higher, particularly in the transverse orientation and for stronger tempers. It has been determined that after 3000 hours at an exposure temperature of 105° C., a copper alloy C19700 connector in the hard temper, typically has about 64% stress remaining in the longitudinal direction and 56% stress remaining in the transverse direction.

The resistance to stress relaxation can be improved by a relief anneal. After the copper alloy sheet is rolled to final gage, it may be relief annealed for a hard temper by bell annealing at a strip temperature of from 200° C. to 400° C. for from 30 seconds to 4 hours. Strip annealing at corresponding higher temperatures and shorter exposure times is also useful. A connector formed from copper alloy C19700 in the hard/relief anneal temper typically has a longitudinal value of 72% stress remaining and a transverse value of 65% stress remaining after the same exposure to 105° C. for 3000 hours.

Directionality is defined with reference to FIG. 1. A sheet 10 of a desired copper alloy is reduced in thickness by passing through the rolls 12 of a rolling mill. The copper alloy sheet 10 then has a longitudinal axis 14 along the rolling direction that is perpendicular to an axis 16 about which the rolls 12 rotate. The transverse axis 18 of the copper alloy sheet 10 is perpendicular to the longitudinal axis 14. Spring contacts formed from the copper alloy sheet and oriented parallel to the rolling direction are referred to as having a longitudinal (or good-way) orientation while spring contacts having an orientation transverse to the rolling direction are referred to as having a transverse (or bad-way) orientation.

United States patents that disclose a copper alloy containing iron, phosphorous and magnesium include U.S. Pat. No. 4,305,762 to Caron et al. and U.S. Pat. No. 4,605,532 to Knorr et al. Both of which are incorporated by reference in their entireties herein.

The Caron et al. patent discloses a copper alloy containing 0.04%–0.20% of magnesium, phosphorous and iron. The Knorr et al. patent discloses a copper alloy containing 0.01%–0.20% magnesium, 0.1%–0.4% phosphorous, 0.3%–1.6% iron and the balance copper. Published Japanese patent application No. JP 58-199835 by Sumitomo Electric discloses a copper alloy that contains 0.03%–0.3% magnesium, 0.03%–0.3% iron, 0.1%–0.3% phosphorous and the balance copper.

While copper alloys containing magnesium, phosphorous and iron are known, there remains a need for a copper alloy with an improved combination of electrical conductivity, strength and resistance to stress relaxation.

SUMMARY OF THE INVENTION

Accordingly, it is an object of the invention to provide a copper alloy having an improved resistance to stress relaxation at temperatures of 105° C. and above. It is a feature of the invention that the copper alloy contains controlled amounts of iron, phosphorous and magnesium with an effective amount of magnesium remaining in solution with the copper to favorably affect stress relaxation performance.

Among the advantages of the copper alloy of the invention are that in excess of about 70% of the applied stress remains, in both the transverse and longitudinal directions, following exposure to 105° C. for 3000 hours. The alloy has an electrical conductivity on the order of 80% IACS and is particularly suitable for use as an electrical connector. IACS stands for International Annealed Copper Standard and assigns "pure" copper an electrical conductivity value of 100% IACS at 20° C.

In accordance with the invention, there is provided a copper alloy. The copper alloy contains, by weight, 0.07%–0.17% phosphorous, 0.1%–1.5% iron and the balance is copper and unavoidable impurities. The copper alloy further contains magnesium in solution with the copper in an amount effective to improve resistance to stress relaxation at elevated temperatures.

The above stated objects, features and advantages will become more apparent from the specification and drawings that follow.

DETAILED DESCRIPTION

Figure 1:
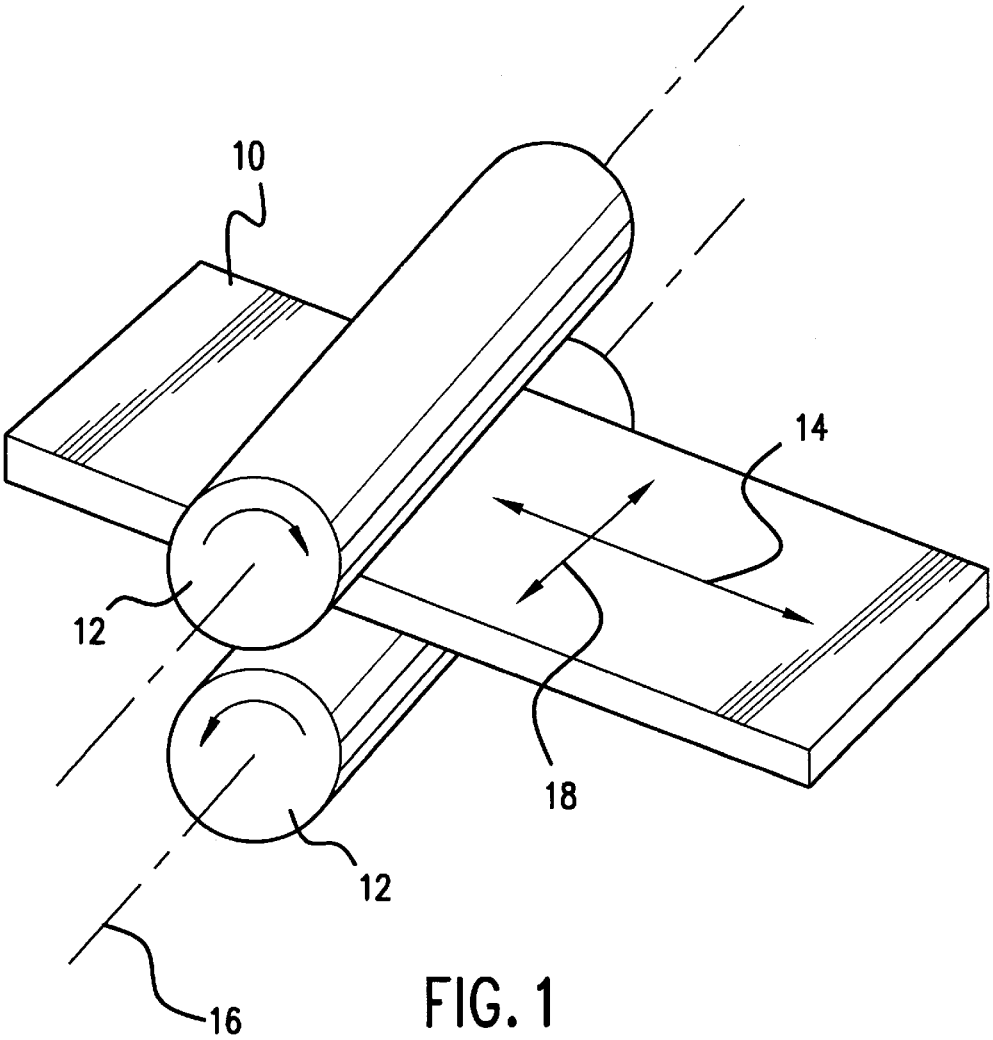
FIG. 1 schematically illustrates the transverse and longitudinal axes of a strip of copper alloy.
Figure 2:
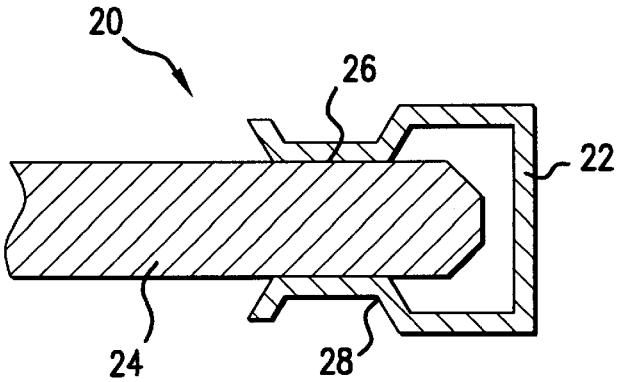
FIG. 2 shows in cross-sectional representation an electrical connector formed from the copper alloys of the invention.

FIG. 2 illustrates in cross-sectional representation an electrical connector assembly 20 utilizing the copper alloys of the invention. The connector assembly 20 includes a socket 22 and a plug or jack 24. The socket 22 is formed from a strip of the copper alloy and bent into a desired shape, typically with a flat 26 for contacting the plug 24. To maintain consistent contact with the plug 24, a bend 28 generates an internal stress in the copper alloy strip drawing the flats 26 against the plug 24. When the connector is exposed to temperatures above room temperature (nominally 25° C.), and more notably when the temperature is in excess of 100° C., this internal stress gradually dissipates and contact between the flats 26 and plug 24 deteriorates. The alloys of the invention better resist elevated temperature stress relaxation and produce an improved electrical connector.

The iron content of the alloys of the invention is similar to that specified for copper alloy C19700, by weight, 0.1%–1.5% iron. The phosphorous content, 0.07%–0.17%, by weight, phosphorous, is at the low end of the range specified for copper alloy C19700 to retain magnesium in solid solution with the copper.

Excess iron in solution with the copper reduces electrical conductivity below the target of 80% IACS and, preferably, the iron content is between about 0.3% and 0.7% and most preferably, between about 0.35% and 0.50%. Preferably, the phosphorous content is between 0.1% and 0.15%.

Up to 50% of the iron may be substituted with another transition metal such as manganese, cobalt, nickel and alloys thereof as a 1:1 substitution, by weight.

Good resistance to stress relaxation, is accomplished by the presence of magnesium in solution with the copper. Magnesium in solution with the copper is referred to as "free magnesium" and is distinguished from magnesium in the form of magnesium phosphides ($Mg_3P_2$) that precipitate from the alloy matrix during processing. Magnesium that combines with phosphorous as phosphide particles has little or no effect on stress relaxation.

In the copper alloys of the invention, iron, phosphorous and magnesium interact to determine the free magnesium content. During processing of copper alloy strip from cast ingots, iron phosphides precipitate from the alloy matrix before the magnesium phosphides. If there is any magnesium left in solution after the phosphorous is completely precipitated as $Fe_2P$ and $Mg_3P_2$, this magnesium will favorably influence stress relaxation performance.

The free magnesium content is calculated by first determining the amount of phosphorous available to combine with magnesium.

$$X=1.18(P—Fe/3.6) \quad (1)$$

if X is negative, then the free magnesium content equals the magnesium content of the alloy. If X is equal to zero or a positive number, then the free magnesium content is equal to $$Y=Mg-[1.18(P—Fe/3.6)] \quad (2)$$

Y is the free magnesium content and is a value greater than 0. While even trace amounts of free magnesium will increase the resistance to stress relaxation, there should be at least 0.1%, by weight of free magnesium and preferably, at least 0.2% of free magnesium. To consistently obtain at least 70% stress remaining after an exposure of 3000 hours at 105° C., at least about 0.03%, by weight of free magnesium should be present.

Excess magnesium may cause cracking and sliver defects during hot rolling and the maximum magnesium content should be less than about 0.1%, by weight. For an alloy containing between 0.3% and 0.7%, by weight of iron and between 0.1% and 0.17%, by weight of phosphorous, the magnesium content will typically be between about 0.03% and 0.08%.

The advantages of the alloys of the invention will become more apparent from the Examples that follow.

EXAMPLES

Example 1

Copper alloys having the compositions specified in Table 1 were cast as 10 pound ingots and rolled to a strip having a thickness of 0.02 inch. The strip was imparted with a hard/relief anneal temper by the process steps of hot roll, diffusion anneal at 600° C., cold roll, anneal at 525° C., roll to final gage and then relief anneal at 250° C. for from 2 to 8 hours.

The resistance to stress relaxation of the strips was then evaluated by constraining a cantilever beam formed from the copper alloy to a fixed deflection and measuring the load exerted by the beam on the constraint as a function of time at temperature. The initial stress at the surface of the test sample was set to 80% of the room temperature 0.2% offset yield strength.

As illustrated in Table 1, the percent stress remaining in both the longitudinal and transverse directions increases as a function of the free magnesium content. When the free magnesium content exceeds about 0.03%, by weight, at least 70% stress remains after 3000 hours exposure at 105° C. in both the longitudinal and transverse directions.

Figure 3:
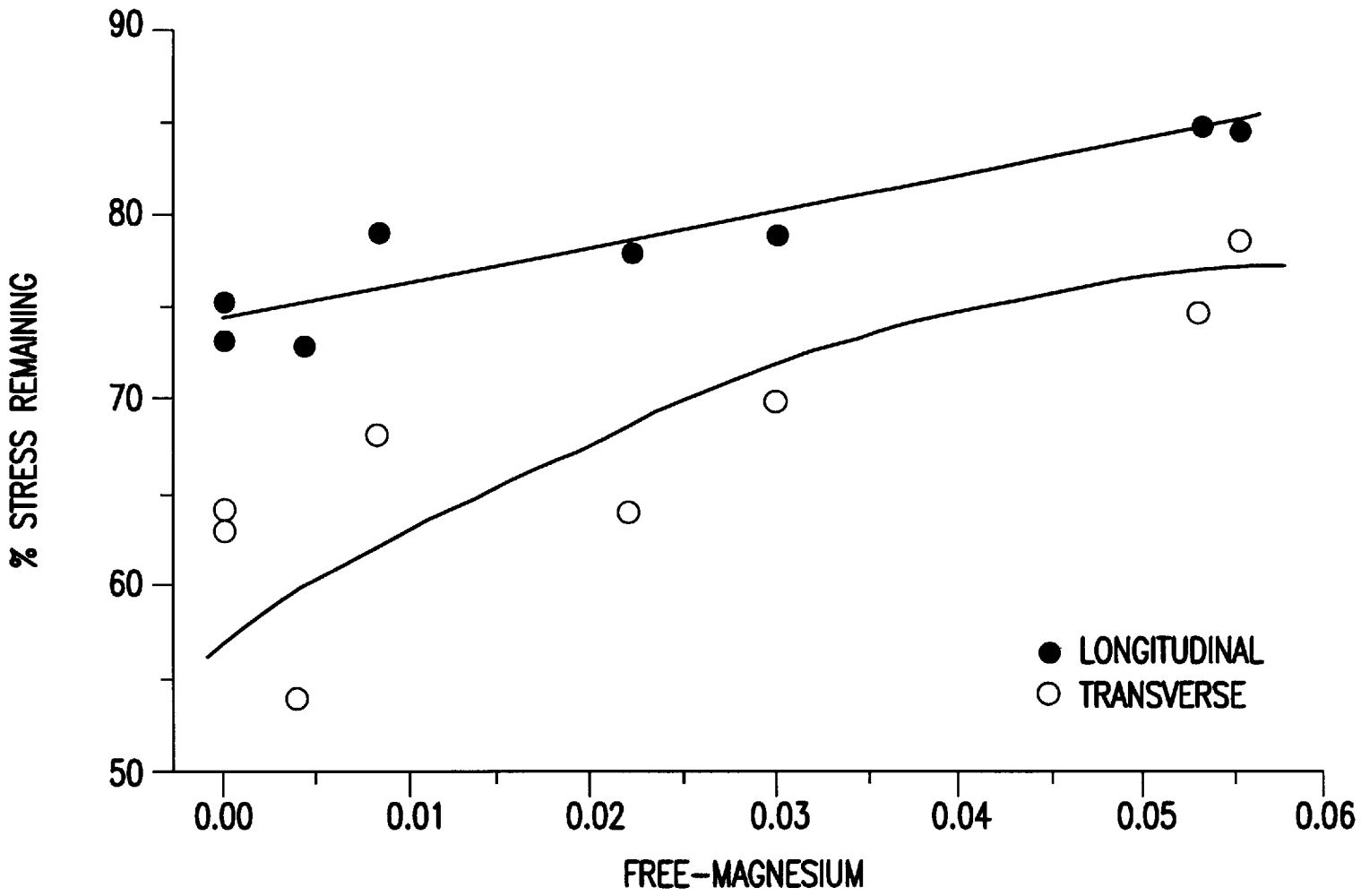
FIGS. 3–5 graphically illustrate the effect of free magnesium on the percent stress remaining in the copper alloys of the invention.

FIG. 3 illustrates the percent stress remaining following exposure at 105° C. for 3000 hours for copper alloys of the invention in the hard/relief anneal temper as a function of the free magnesium content. The steeper slope for the percentage of stress remaining along the transverse direction indicates that the free magnesium has a greater effect on resistance to stress relaxation for connector components oriented in that direction than on connector components oriented in the longitudinal direction. This is believed due to the interaction of the free magnesium with the dislocation microstructure such that the crystallographic texture becomes less significant. The enhanced benefit in the transverse orientation is particularly beneficial since most components are stamped transverse to the rolling direction of the copper strip.

Figure 4:
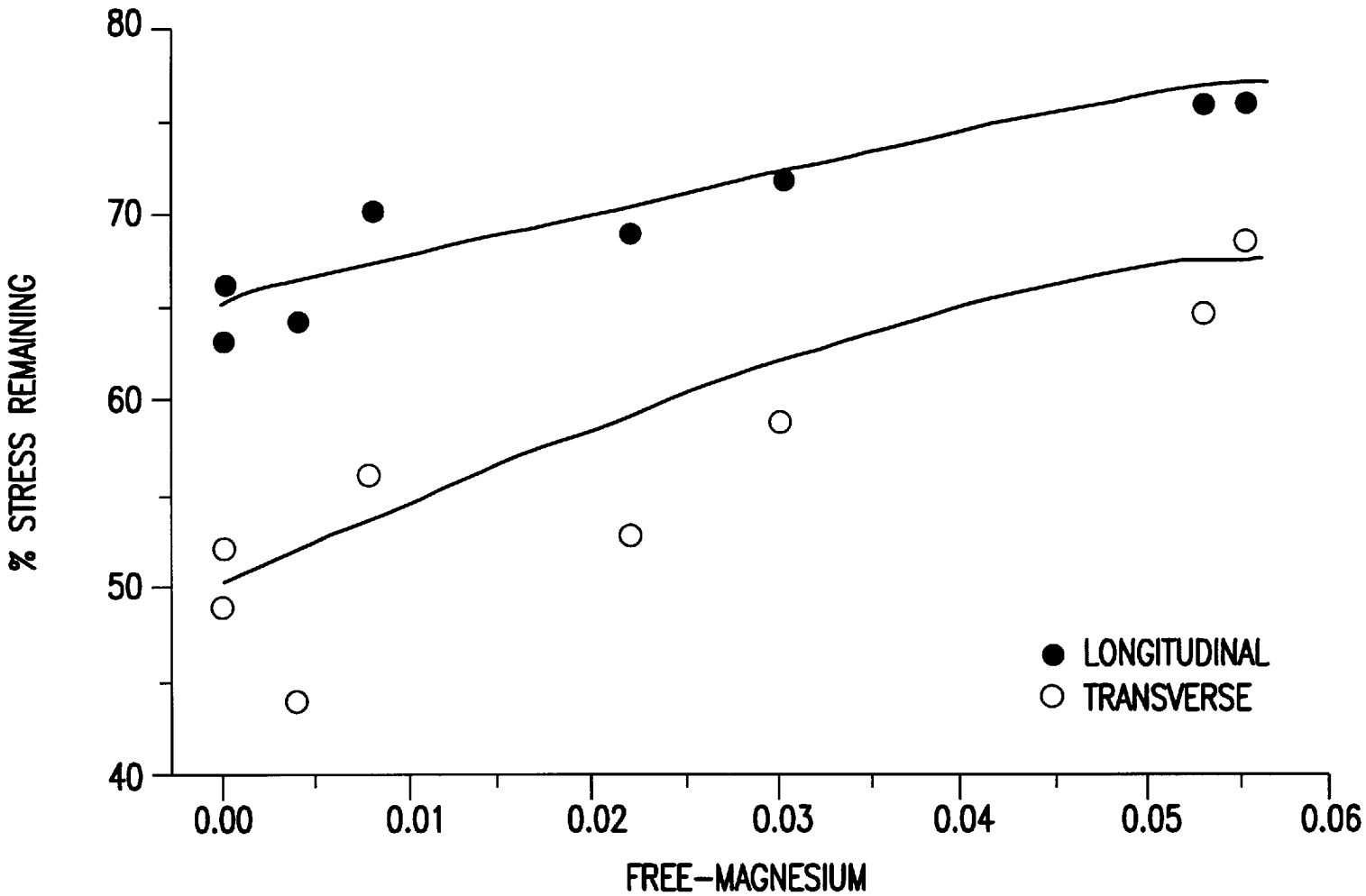

FIG. 4 illustrates that increasing the amount of free magnesium also improves the stress relaxation resistance at the higher temperature of 125° C. following a 3000 hour exposure.

in the art in light of the foregoing description. Accordingly, it is intended to embrace all such alternatives, modifications and variations as fall within the spirit and broad scope of the appended claims.

TABLE 1

Stress Relaxation Properties for Hard/RA Temper

| Sample Identification | Composition Fe/P/Mg | Free-Mg+ | G.S., um | Tensile, YS/UTS/% E1 | % IACS | % SR @ 105° C. Long | % SR @ 105° C. Trans | % SR @ 125° C. Long | % SR @ 125° C. Trans |
|---|---|---|---|---|---|---|---|---|---|
| H441 | 0.29/0.15/0.047 | 0.000 | 7 | 64/66/6 | 83 | 75 | 64 | 63 | 49 |
| H365 | 0.24/0.13/0.044 | 0.000 | 6 | 63/65/6 | 81 | 73* | 63* | 66 | 52 |
| H367 | 0.48/0.14/0.012 | 0.004 | 9 | 61/63/5 | 90 | 73 | 54 | 64 | 44 |
| RN271680 | 0.57/0.19/0.045 | 0.008 | 5 | 66/68/6 | 87 | 79* | 68* | 70 | 56 |
| RN282813 | 0.36/0.10/0.022 | 0.022 | 7 | 61/63/5 | 90 | 78* | 64* | 69 | 53 |
| H369 | 0.39/0.11/0.032 | 0.030 | 10 | 61/64/6 | 85 | 79 | 70 | 72 | 59 |
| H366 | 0.49/0.13/0.053 | 0.053 | 7 | 64/66/5 | 82 | 85* | 75* | 76 | 65 |
| H406 | 0.41/0.09/0.055 | 0.055 | 9 | 61/64/6 | 72 | 85 | 79 | 76 | 69 |

*Extrapolated to 3000 Hrs from 2000 Hrs. All other date is extrapolated to 3000 Hrs from 1000 Hrs.
+If 1.18 (P—Fe/3.6) is negative, free-Mg equals Mg content; otherwise, free-Mg equals Mg-[1.18(P—Fe/3.6)].
G.S. = grain size in microns.
YS = room temperature yield strength.
UTS = room temperature ultimate tensile strength.
EL = room temperature elongation.
SR = stress remaining.
Long = longitudinal orientation and trans = transverse orientation.

TABLE 2

Stress Relaxation Properties for Hard Temper

| Sample Identification | Composition Fe/P/Mg | Free-Mg+ | G.S., um | Tensile, YS/UTS/% E1 | % IACS | % SR @ 105° C. Long | % SR @ 105° C. Trans |
|---|---|---|---|---|---|---|---|
| H365 | 0.24/0.13/0.044 | 0.000 | 6 | 61/63/3 | 84 | 59 | 49 |
| RN271680 | 0.57/0.19/0.045 | 0.008 | 5 | 64/66/4 | 88 | 64 | 56 |
| RN282813 | 0.36/0.10/0.022 | 0.022 | 6 | 60/62/3 | 89 | 65 | 58 |
| H366 | 0.49/0.13/0.053 | 0.053 | 5 | 62/64/3 | 81 | 68 | 63 |

*Extrapolated to 3000 Hrs from 2000 Hrs.
+If 1.18 (P—Fe/3.6) is negative, free-Mg equals Mg content; otherwise, free-Mg equals Mg-[1.18 (P—Fe/3.6)].

Example 2

Copper alloys of the compositions specified in Table 2 were cast and rolled to strip having a thickness of 0.02 inch as above. The alloys were then imparted with a hard temper by hot rolling, cold rolling, annealing at 500° C.–600° C., cold roll, anneal at 450° C.–525° C., then cold roll to gage with a minimum reduction in the last pass of about 50%.

Table 2 illustrates that the presence of free magnesium improves the resistance to stress relaxation of the copper alloys in the hard temper.

Figure 5:
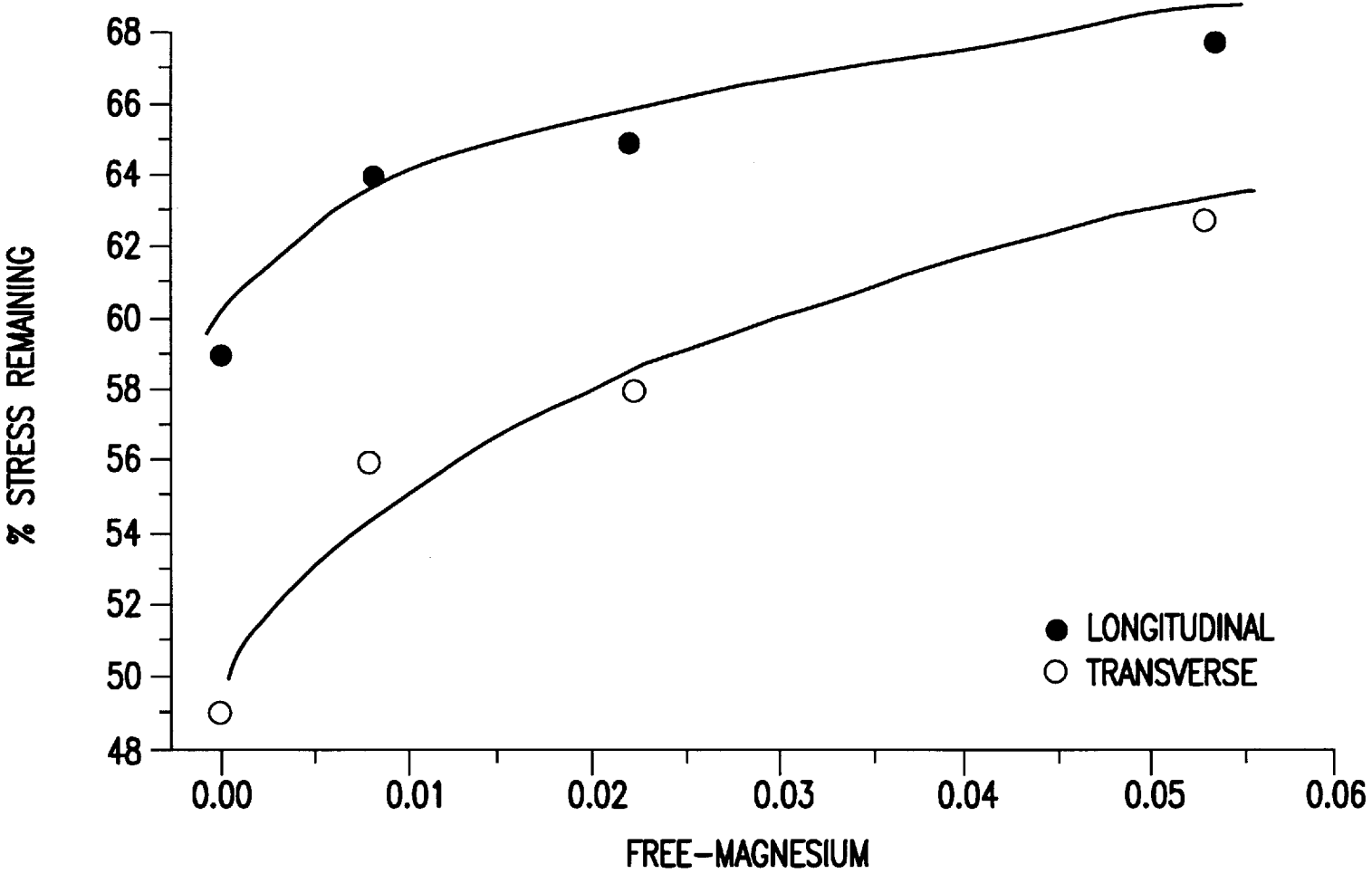

As shown in FIG. 5, the enhancement to resistance to stress relaxation is again more pronounced in the transverse direction as compared to the longitudinal direction. However, the inclusion of free magnesium improves the resistance to stress relaxation in bends formed along either axis.

It is apparent that there has been provided in accordance with the invention a copper alloy that fully satisfies the objects, means and advantages set forth hereinabove. While the invention has been described in combination with embodiments thereof, it is apparent that many alternatives, modifications and variations will be apparent to those skilled

I claim:

1. A copper alloy consisting essentially of:

from 0.1 to 0.17 weight percent phosphorous;

from 0.1 to 1.5 weight percent iron; and the balance copper and unavoidable impurities wherein said copper alloy further contains free magnesium in solid solution with said copper in an amount effective to improve resistance to stress relaxation at elevated temperatures, said free magnesium content, Y, being equal to Y=Mg−X where X is the amount of phosphorous available to combine with magnesium and X=1.18 (P—Fe/3.6) and with X being equal to or greater than zero and Y being greater than 0.03.

2. The copper alloy of claim 1 wherein X is greater than 0.03.

3. The copper alloy of claim 1 wherein said iron content is between 0.3 and 0.7 weight percent.

4. The copper alloy of claim 3 wherein said phosphorous content is between 0.1 and 0.15 weight percent.

5. The copper alloy of claim 3 wherein up to 50% of the iron is substituted with another transition element on a 1:1 replacement basis by weight.

6. The copper alloy of claim 5 wherein said another transition element is selected from the group consisting of manganese, cobalt, nickel and alloys thereof.

7. The copper alloy of claim 6 formed into a sheet by passing through a rolling mill, said sheet having a longitudinal axis that is parallel to a rolling direction and a transverse axis.

8. An electrical connector component formed from said sheet of claim 7.

9. The electrical connector component of claim 8 having an orientation transverse to said rolling direction.

10. A copper alloy consisting essentially of:

from 0.07 to 0.17 weight percent phosphorous;

from 0.3 to 1.5 weight percent iron; and the balance copper and unavoidable impurities wherein said copper alloy further contains free magnesium in solid solution with said copper in an amount effective to improve resistance to stress relaxation at elevated temperatures, said free magnesium content, Y, being equal to $Y=Mg-X$ where X is the amount of phosphorous available to combine with magnesium and $X=1.18(P—Fe/3.6)$ and with X being equal to or greater than zero and Y being greater than 0.03.

11. The copper alloy of claim 10 wherein X is greater than 0.03.

12. The copper alloy of claim 10 wherein said iron content is between 0.3 and 0.7 weight percent.

13. The copper alloy of claim 12 wherein said phosphorous content is between 0.1 and 0.15 weight percent.

14. The copper alloy of claim 12 wherein up to 50% of the iron is substituted with another transition element on a 1:1 replacement basis, by weight.

15. The copper alloy of claim 14 wherein said another transition element is selected from the group consisting of manganese, cobalt, nickel and alloys thereof.

16. The copper alloy of claim 15 formed into a sheet by passing through a rolling mill, said sheet having a longitudinal axis that is parallel to a rolling direction and a transverse axis.

17. An electrical connector component formed from the sheet of claim 16.

18. The electrical connector component of claim 17 having an orientation transverse to said rolling direction.

* * * * *